US009573357B2

(12) United States Patent
Bordeaux

(10) Patent No.: US 9,573,357 B2
(45) Date of Patent: Feb. 21, 2017

(54) ONE-PIECE FOAM FRAME FOR MOUNTING SCREEN AND/OR SCREEN STENCIL FILM TO CREATE SCREENS FOR MANUAL AND SMALL OFF-CONTACT PRINTING SUBSTRATES

(71) Applicant: Patricia G. Bordeaux, Glendale, MO (US)

(72) Inventor: Patricia G. Bordeaux, Glendale, MO (US)

( * ) Notice: Subject to any disclaimer, the term of this patent is extended or adjusted under 35 U.S.C. 154(b) by 0 days.

(21) Appl. No.: 14/757,234

(22) Filed: Dec. 9, 2015

(65) Prior Publication Data

US 2016/0288483 A1 Oct. 6, 2016

Related U.S. Application Data

(60) Provisional application No. 62/124,242, filed on Dec. 12, 2014.

(51) Int. Cl.

| | |
|---|---|
| ***B41F 15/34*** | (2006.01) |
| ***B41L 13/00*** | (2006.01) |
| ***B05C 17/08*** | (2006.01) |
| ***B41F 15/36*** | (2006.01) |
| ***B05C 17/06*** | (2006.01) |
| ***B41N 1/24*** | (2006.01) |
| ***B41L 13/02*** | (2006.01) |

(52) U.S. Cl.

CPC ..... *B41F 15/34* (2013.01); *B05C 17/06* (2013.01); *B05C 17/08* (2013.01); *B41F 15/36* (2013.01); *B41L 13/00* (2013.01); *B41L 13/02* (2013.01); *B41N 1/24* (2013.01)

(58) Field of Classification Search

CPC ..... B05C 17/06; B05C 17/08; B41N 1/24; B41F 15/34; B41F 15/36; B41L 13/00; B41L 13/02

See application file for complete search history.

(56) References Cited

U.S. PATENT DOCUMENTS

| | | | |
|---|---|---|---|
| 2,903,967 | A | 9/1959 | Levin |
| 3,788,216 | A | 1/1974 | Lambert |
| 3,908,293 | A | 9/1975 | Newman |
| 3,962,805 | A | 6/1976 | Hamu |
| 4,194,312 | A | 3/1980 | Connors et al. |
| 4,442,772 | A | 4/1984 | Bubley |
| 4,947,561 | A | 8/1990 | Delacroix et al. |
| 5,036,760 | A | 8/1991 | Oozeki |
| 5,058,499 | A | 10/1991 | Christman |
| 5,355,792 | A | 10/1994 | MacNaughton et al. |
| 5,606,911 | A | 3/1997 | Cane |
| 5,606,912 | A | 3/1997 | Cane |
| 5,794,528 | A | 8/1998 | Gronig et al. |
| 5,941,171 | A | 8/1999 | Fromm |
| 5,957,048 | A | 9/1999 | Newman, Jr. |
| 6,258,445 | B1 | 7/2001 | Schilling et al. |

(Continued)

*Primary Examiner* — Matthew G Marini
*Assistant Examiner* — Marissa Ferguson Samreth
(74) *Attorney, Agent, or Firm* — Senniger Powers LLP

(57) ABSTRACT

A portable one-piece foam frame for use in securing a screen and/or screen stencil film for use in an off-contact stenciling operation. The assembly includes a paper or release covering an adhesive on one side of the frame. A non-skid coating may be applied to the base of the frame to keep it from shifting or moving during a stenciling operation.

10 Claims, 5 Drawing Sheets

(56) References Cited

U.S. PATENT DOCUMENTS

| | | | | |
|---|---|---|---|---|
| 6,379,765 | B1 * | 4/2002 | Woods | A47G 1/0633 40/702 |
| 6,553,904 | B1 | 4/2003 | Goss | |
| 6,962,111 | B2 | 11/2005 | Tanaka et al. | |
| 7,117,787 | B2 | 10/2006 | Thomas et al. | |
| 7,121,196 | B2 | 10/2006 | Mellis | |
| 7,337,718 | B2 | 3/2008 | Chen | |
| 7,536,951 | B2 | 5/2009 | Vasilantone | |
| 7,632,560 | B2 | 12/2009 | Filippini Fantoni et al. | |
| 8,522,681 | B2 | 9/2013 | Niswonger | |
| 2003/0159601 | A1 * | 8/2003 | Wynne | B05C 17/06 101/128.21 |
| 2005/0274655 | A1 * | 12/2005 | Barrett | B07B 1/4609 209/392 |
| 2006/0163121 | A1 * | 7/2006 | Fisher | B01D 33/0376 209/399 |
| 2007/0108107 | A1 * | 5/2007 | Morrow | B07B 1/46 209/405 |
| 2008/0276927 | A1 * | 11/2008 | Martin | F24B 1/192 126/547 |
| 2010/0180483 | A1 * | 7/2010 | Mindel | A47G 1/17 40/760 |
| 2012/0183704 | A1 * | 7/2012 | Chen Lin | A47G 1/0638 428/14 |
| 2014/0290509 | A1 * | 10/2014 | Bennett | B41F 15/36 101/127.1 |

* cited by examiner

ONE-PIECE FOAM FRAME FOR MOUNTING SCREEN AND/OR SCREEN STENCIL FILM TO CREATE SCREENS FOR MANUAL AND SMALL OFF-CONTACT PRINTING SUBSTRATES

CROSS REFERENCE TO RELATED APPLICATION

This non provisional patent application claims priority to the provisional patent application having Ser. No. 62/124,242, filed on Dec. 12, 2014.

FIELD OF THE INVENTION

This invention relates primarily to screen printing frames, and more specifically to a portable, hand operative, one-piece frame designed for manual usage to quickly secure and adequately hold screens and/or screen stencil film for use in manual screen printing of substrates, such as, fabric, paper, glass, metal, wood, and other materials, in an off-contact manner.

BACKGROUND OF THE INVENTION

The present invention relates primarily to a portable, one-piece screen printing frame for amateur and professional use, to quickly and inexpensively, manually print in an off-contact manner onto a substrate, such as fabric, paper, glass, metal, wood, or other items.

There are many low-tech techniques that have been used for many years to stretch mesh over a frame. These include the use of adhesives, staples, tacts, and other fastening devices. While these methods are commonly used, and typically of lower cost, they often take relatively more time and often yield inconsistent results, if not also interfering with the proper use of the stencil, and its repeat usage, particularly where strong adhesives or other types of fasteners, such as staples, are applied. Hence, these types of stencils often take relatively more time to set up, and use, and quite often yield inconsistent results. Also, they are relatively expensive.

Additionally, the storage of screen stencils, as currently used, that are not mounted in a frame, are often problematic as the wet screen stencil films often cling together and to surrounding objects, easily crinkle and fold and subsequently dry in a less than flat or ideal manner. Thus, they are frequently not properly prepared and ready for adequate stenciling usage.

Furthermore, it is currently a common practice in the screen printing industry to use excessive amounts of adhesives in not only constructing a screen, but in taping the perimeter of the screen just before the ink is applied for printing. Screen printers use adhesive tape around the inside edges of the frame, to prevent the applied ink from leaking through any areas that do not have a coating of emulsion hardened on them (i.e. "open" areas of the frame usually around the edges), and/or from ink leaking through the edges of the frame itself.

Screen printers have tried to devise many different ways to tape a screen printing frame and many types of tape have been used and applied. Some printers use packaging tape from office supply stores. Others use duck tape. Also many others use the more expensive solvent-resistant block out tape, which were designed for accommodating screen printing inks.

Many packaging tapes are readily identified as bad news for screens, as these tapes leave gooey residue on the screen and frame. Residue that is difficult to remove. Professional block out tapes normally peal off cleanly from the screen, without leaving adhesive residue, but these types of tapes are quite costly.

Various prior patents have shown related styles of stenciling devices, primarily for industrial and commercial type usage, as distinct from the manual hand held style of stenciling device of this invention. Various types of tensioning mesh onto frames, and numerous frame units have been used and developed. These include the use of relatively complicated constructed equipment, for example, pneumatic, pre-tensioning devices, added materials, primarily for use for fastening, such as clips, tensioning tools, rollers, locking strips, and the like, as well as through the usage of excessive force, which therefore results in relatively more complex and much higher cost frames. Moreover, these commercial grade quality frames are capable of achieving very high-tension screens for printing, although it has been stated that above a certain point, higher tension is not always better for producing quality results, and not always worth the additional time and cost.

A quick summarization of these types of screens, and tensioning systems, can be seen, for example, in the U.S. Pat. No. 7,536,951, to Vasilantone.

The screen tensioning and printing frame of Newman, can be seen in U.S. Pat. No. 3,908,293. As can be noted, these are far more complex of structure and obviously of higher costs, than the current invention.

A two-part frame and pre-tensioning device therefor is shown in the patent to MacNaughton, et al, U.S. Pat. No. 5,355,792.

A further screen printing stencil can be seen in a further patent of Cane, U.S. Pat. No. 5,606,911.

A further self-tensioning silk screen frame can be noted in the United States Patent to Goss, U.S. Pat. No. 6,553,904.

Another tensioning device can be seen in a further patent of Cane, U.S. Pat. No. 5,606,912.

A far more complex stencil holder can be seen in the patent of Fromm, U.S. Pat. No. 5,941,171.

A locking strip panel for silk screen frame can be seen in the patent to Niswonger, U.S. Pat. No. 8,522,681.

The patent to Fantoni, et al, shows the use of a doctor blade upon a cylinder for material coating, in U.S. Pat. No. 7,632,560.

The patent to Chen shows an elaborate commercial screen printing machine in U.S. Pat. No. 7,337,718.

The patent Thomas, et al, shows a multi-frame screen printing device, in U.S. Pat. No. 7,117,787.

U.S. Pat. No. 6,962,111, to Tanaka, et al, shows a screen-printing plate.

The patent Schilling, et al, U.S. Pat. No. 6,258,445, shows a screen printing form and a flexible screen printing form accommodating device.

The patent Newman Jr., shows a clamping strip and locking channels, apparently for application of a screen printing fabric to a cylinder, as in U.S. Pat. No. 5,957,048.

The patent Gronig, et al, U.S. Pat. No. 5,794,528, shows another device for holding tensioned sheet-like material and process for tensioning said material.

The patent to Oozeki, U.S. Pat. No. 5,037,760, shows another screen printing machine.

The patent Mellis, U.S. Pat. No. 7,121,196, shows a device and method for applying patterns and/or labels to a substantially flat surface of an article.

Another wire mesh screen can be seen to Levin, U.S. Pat. No. 2,903,967.

A further adjustable screen printing chase can be seen in the patent to Lambert, U.S. Pat. No. 3,788,216.

A fastening device for use in needle point as in a supporting frame and clip assembly, can be seen in the patent Connors, et al, U.S. Pat. No. 4,194,132.

Another screen tensioning apparatus can be seen in the patents to Bubley, U.S. Pat. No. 4,442,772 and U.S. Pat. No. 3,608,484.

A frame for cloth and artistic canvases can be noted in the patent to Delacroix, et al, U.S. Pat. No. 4,947,561.

A device for imprinting an image on a substrate is noted in the patent to Christman, U.S. Pat. No. 5,058,499.

The patent to Levin, U.S. Pat. No. 2,903,967 also shows a wire mesh screen.

Finally, a gripping device, for flexible sheet material, can be seen in the patents to Hamu, U.S. Pat. No. 3,962,805, and U.S. Pat. No. 4,694,746.

These are examples of a variety of prior art frames, gripping devices, stretching apparatuses, as known and used in the prior art.

SUMMARY OF THE INVENTION

The present invention provides a simple, portable, lightweight, water resistant, one-piece foam frame with peel and stick surface on one side of the frame to allow an amateur or professional user to quickly secure and adequately hold and ultimately clean, dry and store, screens and/or screen stencil film for use in off-contact, manual screen printing in a cost and space efficient manner.

This invention contemplates a portable, one-piece foam frame, as aforesaid, with peel and stick surface on one side of the frame to allow an amateur or the professional user to quickly secure and hold screens and/or screen stencil film to create screen stencils for manually printing off-contact in a cost and space efficient manner, because of the structure and ease of method of usage of the frame member of this invention. The assembly includes a foam frame with peel and stick surface on one side, which, when applied to the dry screen stencil, effectively holds the screen stencil in a flat and stretched state to create screens for rapid printing of multiple items.

To allow for elevated, off contact printing, there needs to be an appropriate distance between the screen and the substrate. This is known as the "off-contact" distance or "snap" and is a crucial feature of the screen printing technique especially for this invention. The gap between the two surfaces is mostly dependent on the size of the screen and the tension in the mesh. Large screens are set with more off-contact than smaller screens, and highly tensioned screens require less off-contact than weakly tensioned screens. In a commercial setting, the off-contact is adjusted for each job to accommodate for the variables using a variety of techniques.

Although off-contact is an important concept for screen printing, it is many times not addressed in the consumer market. Screen stencils are shown resting directly on a substrate with no off-contact distance to separate the screen stencil from the substrate. The screen stencil either rests there freely or is taped to the substrate along the perimeter of the stencil or along a thin frame that again, does not elevate the screen stencil to an off contact distance. The ink on the squeegee is then subsequently applied. This technique will often yield inconsistent results with blurred and/or smudged images as the frame moves slightly across the substrate during printing, or shifts upon removal of the screen stencil. Furthermore, the now ink filled screen cannot be moved to a fresh substrate and adequately positioned as ink will prematurely leak through the screen and onto the new substrate.

With the present invention, the thickness of the foam frame provides the ideal distance for the screen stencil to reside above the substrate which results in an off contact manner of printing, providing clear and consistent results which can easily and quickly be moved from substrate to substrate for multiple prints. Additionally, the nature of the frame's foam makeup allows the frame to "give" slightly as pressure is applied to the screen. When such pressure is not being applied, the foam frame allows the screen stencil to "snap" back to a height above the substrate, leaving a very "crisp" image printed upon the substrate below.

Moreover, traditional screen printing methods consistently call for the "squeegee side" of the frame to be the side of the frame with the "well" or high side of the frame around it and the "substrate side" of the frame to be the flat or screen stencil side of the frame. The present invention effectively "flips" the frame over and directs the "squeegee side" of the frame to become the flat side of the frame, thus creating an off contact distance from stencil to substrate using the very nature of the thickness and material of the frame itself to provide for the off contact distance. Subsequently, the "substrate side" of the frame becomes the "well" side of the frame with only the frame's perimeter touching the substrate.

The present invention is a time efficient, low cost, and alternative for the amateur or professional user that provides consistent printing results.

To make the screen taut and ready for printing, peel off and discard the paper or release covering the adhesive on the one side of the foam frame. Apply this adhesive side of the foam frame to the back side of the screen stencil. Push firmly around all edges to adhere the foam frame to the screen stencil. Flip the frame over and place on the substrate. Apply an ink filled squeegee to the front of the screen and swipe across the screen using even pressure and a steady pace to make one pass. As the squeegee moves along the screen, the nature of the foam frame allows the screen to temporarily come in contact with the substrate and then "snap back" to a height above the substrate when the squeegee has passed, leaving a crisp, printed image upon the substrate below.

After printing, the screens must be cleaned so that they may dry properly and be stored, free from ink and residue while still in a flat and stretched state. The present invention is comprised of light-weight and water-friendly materials, preferably polymer or other materials that can be rinsed and cleaned with screen stencil film still residing and maintained within their framework. Moreover, the profile of the present invention will be relatively diminutive in thickness as compared to the prior art of thick wooden or aluminum frames currently used. The slim nature of the present invention will allow users to store screen stencils of the present invention within limited square footage storage arrangements. More specifically, the screen stencil films as dried in the present invention can be stacked with and/or leaned against other screens for space saving efficiency, and retain the advantages of drying flat and not sticking to one another.

There are modifications to this invention that further provide for a low cost stencil screen and frame that may be manually used by the consumer, without requiring any expertise in the printing industry, when applying designs or other indicia to tee shirts, and other related materials, as previously reviewed. For example, the density of the foam frame that forms the perimeter for the stenciling frame of this invention, may be such that when applied to a shirt, it will have sufficient softness that it will adhere in place upon the shirt, and likewise, when a stenciling screen is applied to its upper edge, there may be sufficient frictional engagement between these two components that allows the screen to be used for stenciling, and movement of the ink-laden squeegee thereover, without shifting, but yet maintaining that off-contact distance, during usage. This type of foam density forming the frame perhaps could eliminate the usage of any adhesive, upon that upper edged surface, for holding the stencil screen in place. Furthermore, it is likely that the stencil screen could be formed having an integral bead around its perimeter, whether it be of polymer, or any other material, that may be permanently applied around the perimeter of the stencil screen, so that after the screen has been developed, washed, and ready for application for stenciling purposes, such as upon a shirt, all one needs to do is direct the bead side of the stencil screen forming the well side against the shirt or other material to be stenciled, and ready for application. Thus, in the latter instance, the entire stencil screen and its integral bead or perimeter frame could be sold as a unit, for ready application and usage by the consumer.

The type of pressure sensitive adhesive that is applied to the upper edge surface of the foam frame may be obtained from Adchem Company, Riverhead, N.Y., as a pressure sensitive type adhesive, which when its release sheet is removed, provides for adherence with the stencil screen, and holds it in place. Other type of polymer of acrylic type adhesives may also be used for this purpose. In addition, when an adhesive is applied to the bottom surface of the foam frame, it is designed to provide for a high friction contact against the surface being printed. This may be a form of microcell composition, that can be obtained under Model No. MC3800, from Rubberlite, Incorporated, of Huntington, W. Va. Obviously, other types of tacky substances may be used for this purpose that may add a frictional engagement with the surface of the shirt or other product being stenciled.

It is, therefore, the principal object of the present invention to furnish an inexpensive stencil frame that has an off-contact measurement and framing material that provides very crisp, consistent and accurate printing of images upon a substrate or multiple substrates.

Another object of this invention is to provide a frame which will hold a screen stencil off contact at enough distance so that an ink filled screen stencil can be positioned on multiple substrates without marking them until the squeegee is applied. This objective will prove beneficial in accurate graphic placement on multiple substrates during a printing run.

It is an additional aim of this present invention to have a peel rate that will result in commercial quality looking images, as distinguished from blur type of images that may be produced as from the prior art. This peel rate is accomplished by use of the present invention's foam frame.

Another object of this invention is to provide a stencil frame that allows for the embraced screen to snap back to a height above the printed substrate, following a printing cycle, thereby producing a very crisp applied image there below. Under said circumstances, the ink filled screen can easily be lifted off the substrate and moved without blurring the applied printed image.

It is another object of this invention to provide a low profile, light weight, cost efficient manner to wash, dry and store screen stencil films, so that the amateur, and even the professional user, can effectively and efficiently make use of the screen printing frames of this invention.

An additional object of this invention is to avoid the use of any additional types of adhesive material or fastening means during printing, as previously described in the prior art. When the present invention is used with screen stencil film, there are no open areas around the edges of the screen stencil that need to be blocked with the use of additional adhesive tape, duck tape, etc. as is currently done with traditional screen printing instruments.

Yet another primary object of this current invention is to provide a means for securing screen stencils into a flat and stretched state, in a simple, time efficient and low cost manner for use in small screen printing.

Another object of this invention is to provide a means for off-contact printing with the screen as well as having an appropriate snap to it, to add to the effect of its usage.

A further object of this invention is to provide a means for rinsing, drying and finally, storing screens in an appropriate and convenient manner, for later usage.

Another object of his invention is to provide an integral one-piece stencil screen and perimeter frame for use for manual stenciling of print materials.

Yet another object of this invention is to provide a one-piece stencil and polymer frame, the frame being formed of a foamed polymer such as polyurethane foam or polyethylene foam, and related materials, and other polymer foamed materials, which has a density that provides sufficient friction for holding the stencil screen in place during a stenciling operation.

These and other objects may become more apparent to those skilled in the art upon review of the summary of the invention as provided herein, and upon undertaking a study of the description of the preferred embodiments, in view of the drawings.

DESCRIPTION OF THE PREFERRED EMBODIMENT

The present invention will now be described in its structural detail, and in terms of the preferred embodiment. This embodiment, and any modifications, are set forth to aid in the depiction and illustration of the present invention, but are not to be construed as limiting. Throughout the application where the stenciling film is identified as a mesh, mesh stencil, mesh means, screen or screen stencil, generally these are all identified through the use of the term screen or screen stencil. In addition, throughout the application where the stenciling function takes place upon a substrate, that substrate can include any type of fabric, such as clothing, like a shirt, hat, socks, or any other item of clothing, in addition to upholstery, for example, upon chairs or other furniture, and can also include the stenciling upon paper, foam, glass, metal, wood or any other type of structure upon which stenciling may be applied.

Figure 1:
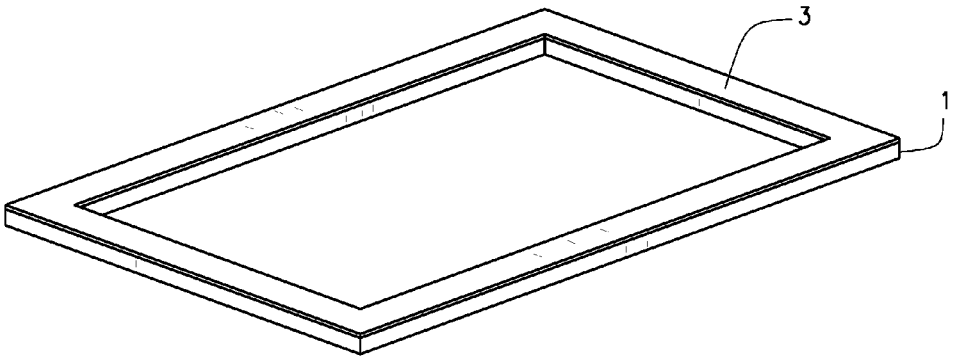
FIG. 1 shows a foam frame with adhesive covered with a paper or other release sheet before usage.
Figure 3:
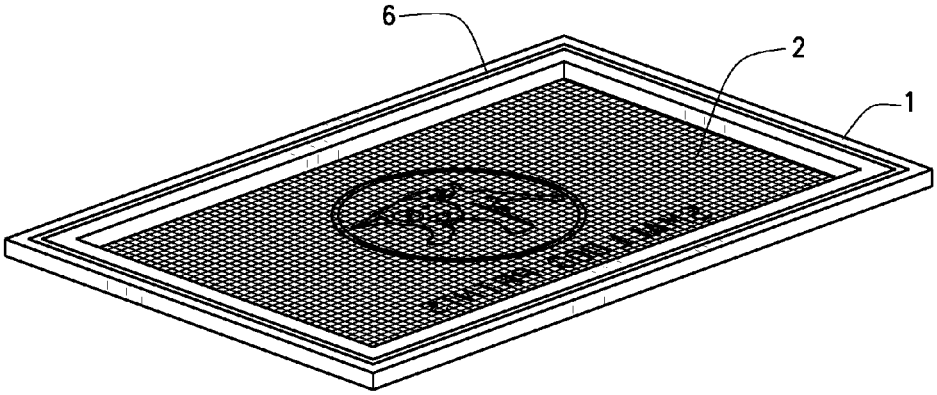
FIG. 3 shows the adhesive side of foam frame being applied to back side of dry screen film or a dry screen stencil.
Figure 4:
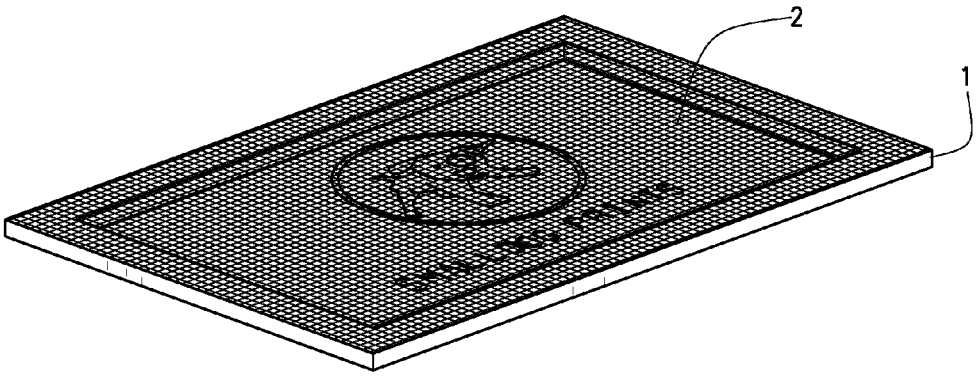
FIG. 4 is an isometric view of foam frame with screen stencil correctly oriented upright before usage.

In referring to the drawings and particularly FIG. 1, the invention is depicted as a portable one-piece frame 1 usable with screens or screen stencil film 2, as noted in FIGS. 3 and 4, to create screens for printing off-contact, upon any substrate, such as fabric, paper, glass, metal, wood or any other materials that normally can be printed through the stenciling method. The preferred material for the frame will generally be of a polymer material having some resiliency, such as polyurethane, polyethylene, polystyrene, polypropylene, or any other material to provide a low cost, light weight, but water-friendly user form of structure, as can be seen. The shape and size of the frames may vary depending upon the dimensions of the mesh stencil film to be used with it, but typically, the frames will be of a rectangular design with exterior dimensions of approximately 4.25 inches by 5.5 inches, or 5.5 inches by 8.5 inches, or 8.5 inches×11 inches to allow for a very ease of portable usage, but obviously, could be of any other size and/or shape, such as circular, round, rectangular, oval, square, hexagonal, triangular, etc., as may be preferred for a given stenciling operation. For example, the concept of this invention can even be used with a frame that may have overall exterior dimensions within the vicinity of 16 inches to 24 inches, and yet be constructed in the manner as described for the invention herein, and have the various dimensional parameters, such as the offset above the substrate being printed, to those dimensions as described herein. Additionally, the width of the frame border may vary but may possibly be between ¼ inch to 1½ inches, depending on the overall size of the frame, noting that smaller frames will necessitate thinner frame borders while larger frames may necessitate wider frame borders. The same can be said with respect to the thickness of the frame what may be ⅛ inch to as much as ½ inch more or less, and which may be appropriate for the structure.

FIG. 1 shows the frame 1 itself, with the paper or other release material 3 applied thereon, on its upper surface, where the upper surface of the foamed frame material includes an adhesive coating, as at 4, as can be noted in FIG. 3. This is the way the framed material may be marketed in a kit, readied for usage and application by the user.

FIG. 4 depicts the front elevational view of the one-piece frame 1 with the thickness and orientation of the foam frame as the focus. Generally, the frame thickness of the present invention may be somewhere in the vicinity of ¼" to ¾", more or less for smaller sized frames, and up to 1 inch and beyond for larger sized frames but not limited to these measurements, as clearly the measurements will be determined according to the size of the frame and materials used, as previously described. Additionally, the orientation of the frame when prepared is noted in FIG. 3, and when used is "flipped upside down", as noted in FIG. 4, as opposed to prior art and traditional screen printing methods. Therefore, the "squeegee side" of the frame is directed to be the "flat" upper side of the frame, and the "substrate side" or lower side of the frame is directed to be noted in FIG. 3, completely contrary to all prior forms of this art. Due to the frame's thickness and "squeegee side" orientation, the actual frame functions to provide an off-contact manner for printing. Additionally, the nature of the foam frame acts to assist with the "snap" while printing so that the "peel rate" is sufficient.

Figure 2:
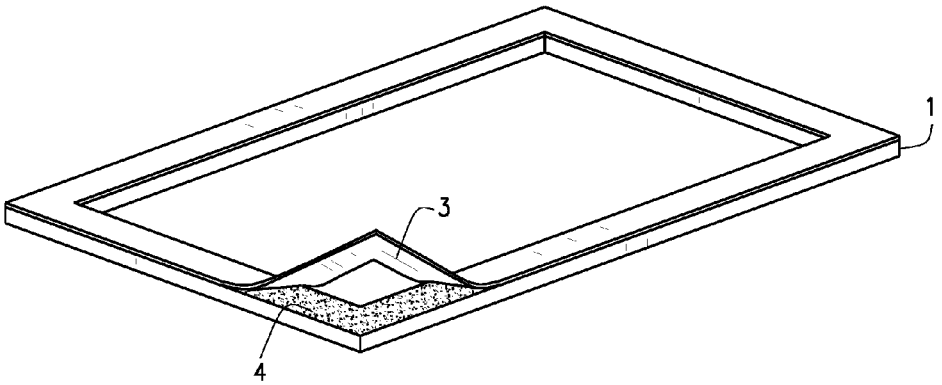
FIG. 2 shows the paper adhesive covering of the release sheet being peeled and discarded.

FIG. 2 depicts the released paper adhesive covering 3 being peeled thus exposing the adhesive material which coats one side of the frame. The preferred adhesive will be strong enough for semi permanent mounting of the screen stencil. This adhesive will most likely be a high performance, pressure sensitive adhesive, for semi permanent mounting of the screen stencil. The adhesive will most likely be based on an elastomer and may or may not be compounded with a tackifier. In addition, when water is applied for cleaning purposes, the adhesive will not interact with applied water so as to lose its strength or hold of the screen stencil and will not wash and subsequently harden onto the screen thus blocking and ruining the "open" areas of the screen stencil. The preferred adhesive will most likely be a high performance, pressure sensitive adhesive, for semi permanent mounting of the screen stencil. The adhesive will most likely be based on an elastomeric and may or may not be compounded with a tackifier, as previously reviewed.

Additionally, the bottom surface of the foam frame which rests on the substrate, as depicted in FIG. 4, may or may not have a non-skid material such as rubber or plastic applied or inherent in the frame so that when the frame is in use, there is high resistance to skidding or slippage across the substrate, such as a shirt, therefore adequately holding the frame in its place while in use to achieve a sharp image.

Figure 5:
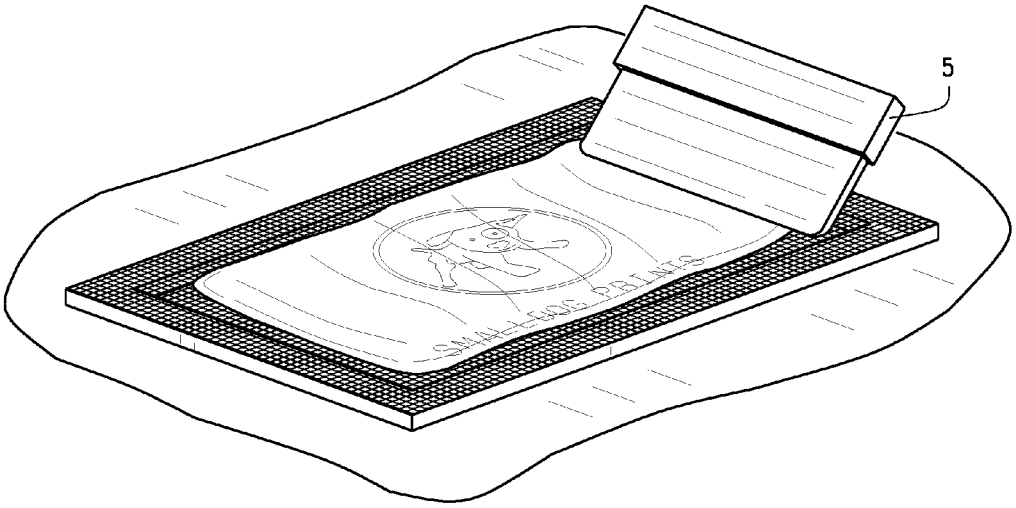
FIG. 5 shows the frame on a substrate and in use.
Figure 6:
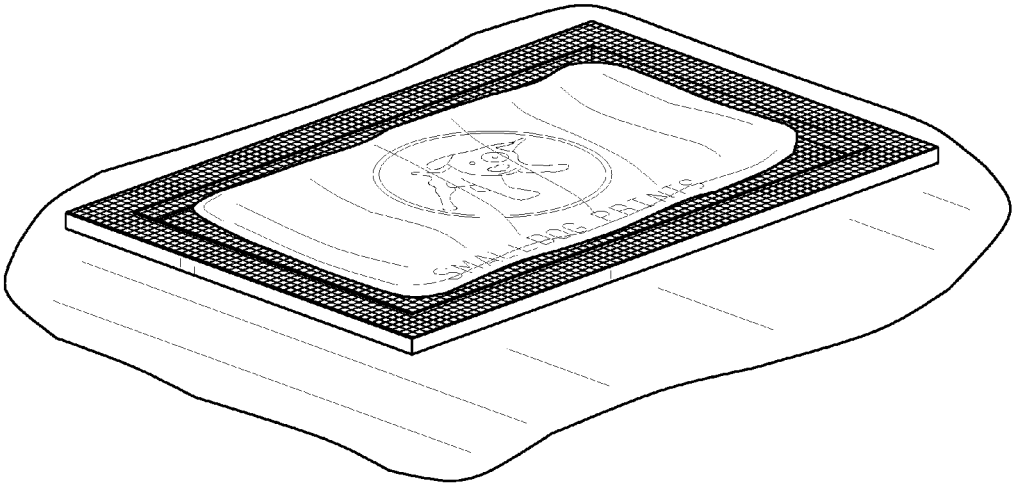
FIG. 6 shows the frame with "off contact" or "snap", or shirt, etc.

The purpose of the foam frame is to provide for an off-contact distance between the frame and the substrate being printed. When a ink-filled screen, such as the one previously identified, is set upon a fresh substrate, generally, such ink will not be deposited onto the screen until it is accurately positioned. This can be seen in FIGS. 5 and 6. Once positioned precisely, and pressure is applied manually to the frame, or pressure is applied to the screen containing the ink through the use of a squeegee or blade 5, as noted in the FIG. 5, and the nature of the foam material forming the frame allows the frame to give slightly, so that the ink is printed onto the substrate below. When no more pressure is being applied, the foam frame allows the screen to snap back to a height above the substrate, leaving a crisp image below, and one that has little to no more contact with the substrate, and therefore, smudging will not occur. See FIG. 6. The desired steady state space between the screen stencil and the substrates being printed may be a fraction of an inch, such as 1/16", ⅛", or ¼" etc., as may be required.

As previously summarized, there is the potential for modifications to this invention where the density of the foamed polymer may be within the range of approximately one to four pounds per cubic foot, where the foamed polymer is a polyurethane, or approximately within a range of one to nine pounds per cubic foot, where the foamed polymer is a polyethylene polymer. Where a softer polymer foam is used, the bottom surface of the frame will have sufficient frictional contact with the substrate to be printed, to hold the frame in place, and the top surface of the frame may have sufficient frictional engagement with the stencil, to also hold it elevated in place, during a stenciling operation, but yet be able to allow the stencil screen to snap upwardly, in an off-contact manner, after the stenciling operation, to assure a clean and crisp image has been applied. In addition, it is also likely that the stencil screen itself, when formed of plastic+6, may be formed with an integral bead around its lower surface, or that surface forming the well and in proximity with the substrate to be imprinted, and that bead will act as a frame for holding the stencil upwardly, in its desired off-contact manner, and be marketed in that condition, ready for application and usage by the consumer, when preparing for a stenciling operation. These are just examples of how the simple concept of this invention may be obtained for forming the one-piece frame and mounting screen for achieving the stenciling operations of this invention. Under such circumstances, the integral bead as partially shown at 6, forming the frame for the stencil may be of a denser polymer, and perhaps can even be molded in place with the screen, when prepared. In addition, it is likely that the stencil screen itself may have an adhesive or tack applied around its underside perimeter, and have the release material applied thereto, so that when it is peeled free, it can be adhered to the upper surface of the foamed frame, readying in the stencil for usage for printing an image or other indicia upon a substrate.

To give an indication of the range of density for such foam, usually, density is measured under the ILD ratings of such foam material. The ILD ratings generally determine the density of the foam. A rating of 1.8 is usually defined as an extra soft foam. A rating of 2.7 is considered a medium density, while a rating of 3.0 is considered an extra firm rating. The for the current invention, and ILD rating of from medium to firm, such as 1.9 to 2.8, will provide a textured foam having a density that can resist pressure, as applied when stenciling, and allow the frame to support the stencil screen during its usage, and maintain it off-contact from the surface of the cloth or sheet being stenciled during a stenciling procedure. In actuality, a density of about 2.8 should usually be sufficient.

Figure 7:
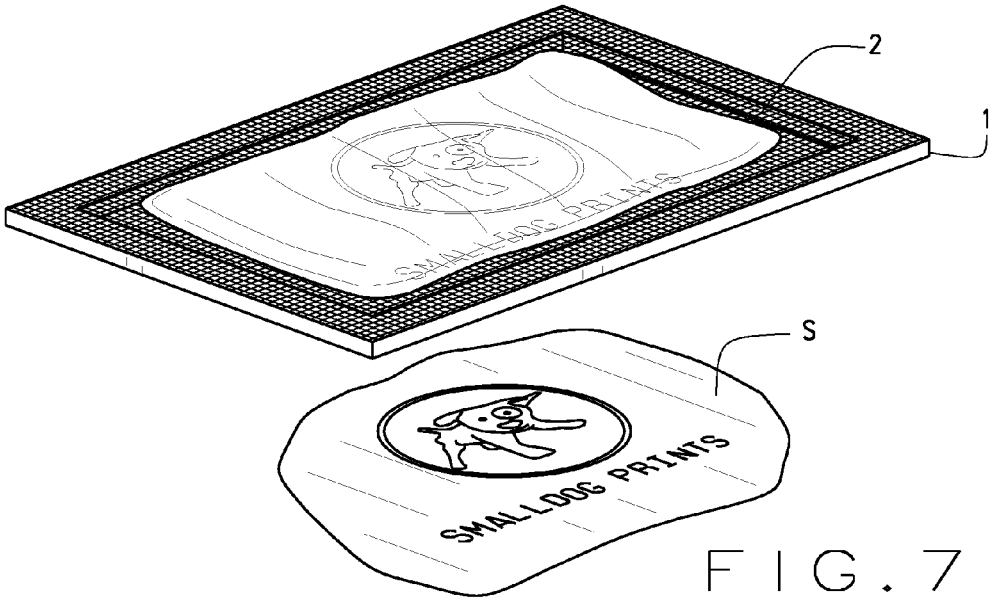
FIG. 7 shows the frame being removed from substrate after application of a print.
Figure 8:
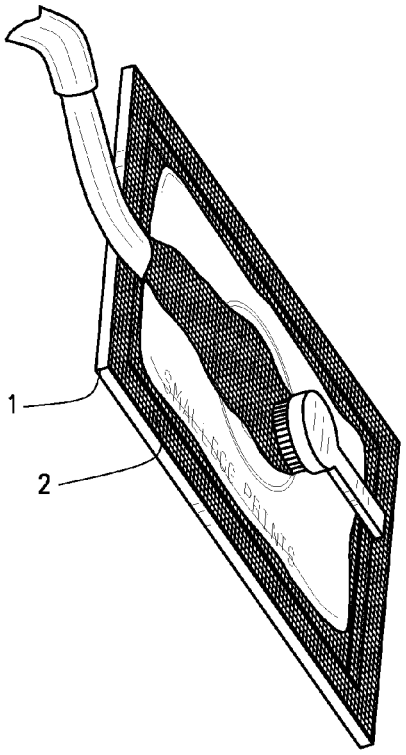
FIG. 8 shows the ease with which a stencil can be rinsed when mounted in the frame.
Figure 9:
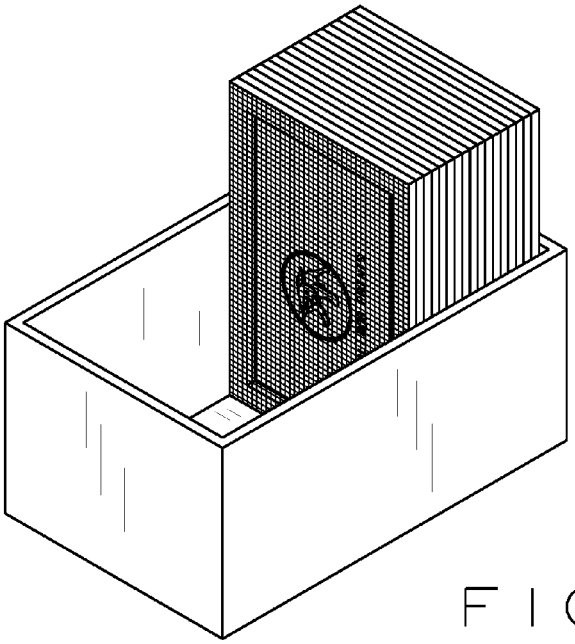
FIG. 9 shows the frames drying in a flat and stretched state and easily stacked together for space efficiency during storage.
Figure 10:
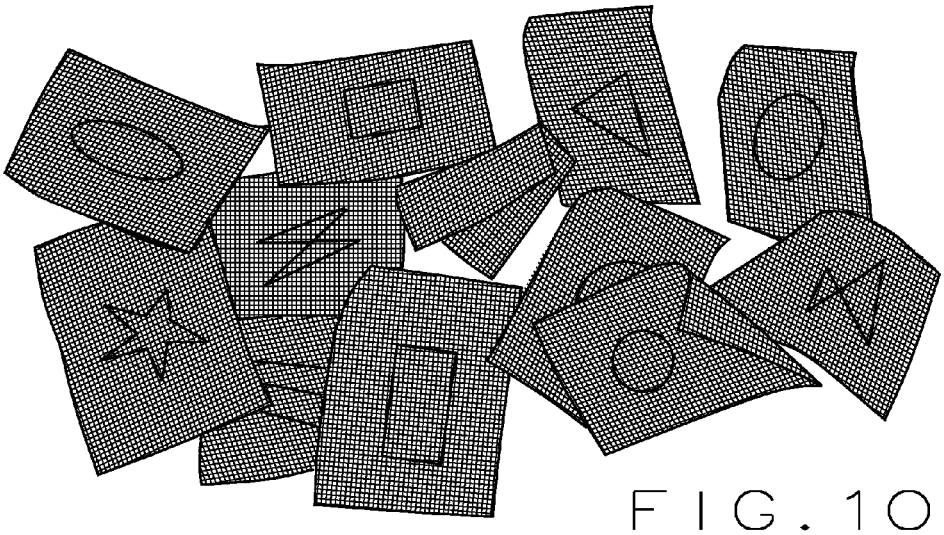
FIG. 10 PRIOR ART
FIG. 10 shows prior art where screen stencils have no frame and are "laid out" to dry and curl.

FIG. 7 shows the frame 1 with its screen 2 being elevated from the substrate S to which the screen print has been previously applied, as noted. FIG. 8 shows the ease at which the stencil can be rinsed, with water, and a brush, even when mounted to its frame 1. FIG. 9 shows how a series of the stencil screens, adhere to their frames, may be stacked flat, and will not adhere to each other, since the screens are separated, as can be noted. Finally, FIG. 10 shows how with prior art type of screens, they can not only stick to each other, but they curl up when drying, and take up space, as when not in usage. Hence, this shows the desirable aspects of the framed stencils, as noted in FIG. 9, and how they can be much more easily handled, during and after usage.

As can be readily recognized from reviewing the concept of this current invention, it is a hand held type of portable stenciling device that can be applied for stenciling small graphics, designs, words, or the like, to a substrate such as a shirt, and once the stenciling pass has occurred, and the squeegee is removed, the screen will bounce upwardly, separating itself from the substrate, so that a clean, crisp print of the design is applied to the shirt, or the like, without any smudging, particularly when the stenciling frame is removed. Additionally, as portrayed above, the foam frame can be moved quickly to multiple substrates and positioned adequately without fear that ink will prematurely be applied to the substrate. Lastly, the foam frame provides a lightweight, inexpensive structure for cleaning, drying in the desired "flat" state and storing screen stencils in a space efficient manner while not in use.

Upon reviewing the subject matter of this invention, various alternative embodiments will become obvious to those skilled in the art, as can be understood. For example, the frame may be formed from any number of polymeric materials, with varying dimensions and strengths of adhesions applied. Additionally, a non-skid surface could be achieved through an inherent process such as stamping the foam, or an applied process such as an application of rubber or additional plastic coating, or such may simply not be needed at all.

Variations or modifications to the subject matter of this invention, as just described, may occur to those skilled in the art upon review of the summary of the invention as provided herein. The description of the invention, as set forth in the preferred embodiment, and its depiction in the drawings, are provided for illustrative purposes only. Any such variations are intended to be encompassed within the scope of any claims to patent protection issuing herein.

I claim:

1. A stencil assembly for screen printing an image on a substrate, said stencil assembly comprising:

a one-piece compressible foam frame having a substrate side for contacting the substrate and a screen side opposite the substrate side, the screen side being spaced from the substrate side by a predetermined distance when the foam frame is in an uncompressed condition, said foam frame having an inner perimeter defining a central opening of the foam frame and an outer perimeter surrounding the inner perimeter; and a screen stencil attached to the screen side of the foam frame outside the inner perimeter so the screen stencil covers the central opening;

wherein when the foam frame is oriented so the substrate side faces downward and the foam frame is positioned so the substrate side contacts an upward-facing planar surface, the screen stencil is spaced from the planar surface;

wherein when the foam frame is positioned so the substrate side contacts the upward-facing planar surface and a distributed load is applied downward on the screen stencil by an edge of a squeegee, the assembly deforms so the screen stencil contacts the substrate along a line having a length equivalent to that of the edge of the squeegee; and wherein when the foam frame is positioned so the substrate side contacts the upward-facing planar surface and the distributed load is removed from the screen stencil, the assembly returns to an undeformed shape so the screen stencil is spaced from the planar surface.

2. A stencil assembly as set forth in claim 1, wherein the foam frame has a stiffness sufficient to stand upright on an end of the foam frame under a combined weight of the foam frame and the screen stencil for storing and drying the assembly.

3. A stencil assembly as set forth in claim 1, wherein the compressible foam frame and screen stencil are insoluble in water thereby permitting cleaning with water.

4. A stencil assembly as set forth in claim 1, wherein the substrate side of the foam frame comprises a non-skid surface.

5. A stencil assembly as set forth in claim 1, wherein the foam frame has a thickness less than about ¾ inch.

6. A stencil assembly as set forth in claim 5, wherein the foam frame has a thickness of at least about ¼ inch.

7. A stencil assembly as set forth in claim 1, wherein the foam frame has a thickness of at least about ¼ inch.

8. A stencil assembly as set forth in claim 1, wherein the foam frame comprises a foam having an Indentation Load Deflection (ILD) rating in a range from about 1.9 to about 3.1.

9. A stencil assembly as set forth in claim 1, wherein the planar surface against which the substrate side is positioned is level.

10. A stencil assembly as set forth in claim 1, wherein the screen stencil provides an off-contact distance of at least about ¼ inch.

* * * * *